US007669252B2

(12) United States Patent
Wei

(10) Patent No.: US 7,669,252 B2
(45) Date of Patent: Mar. 2, 2010

(54) STOCKING

(76) Inventor: Tze-Chun Wei, No. 666, Sec. 1, Chung-Shan Rd., She-Tou Hsiang, Changhua Hsien (TW)

( * ) Notice: Subject to any disclaimer, the term of this patent is extended or adjusted under 35 U.S.C. 154(b) by 649 days.

(21) Appl. No.: 11/530,174

(22) Filed: Sep. 8, 2006

(65) Prior Publication Data

US 2008/0092275 A1 Apr. 24, 2008

(51) Int. Cl.
*A41B 11/00* (2006.01)

(52) U.S. Cl. ..... 2/239

(58) Field of Classification Search ..... 2/239, 2/240, 241, 409, 163, 170, 159; 66/185, 66/187, 178 A
See application file for complete search history.

(56) References Cited

U.S. PATENT DOCUMENTS 1,014,653 A * 1/1912 Kronenberger ..... 2/84
1,092,047 A * 3/1914 Hertz ..... 2/270
1,183,792 A * 5/1916 Aron ..... 2/270
1,310,120 A * 7/1919 Kreamer ..... 2/158
1,393,900 A * 10/1921 Milkes ..... 2/83
2,323,136 A * 6/1943 Johanson ..... 2/158
2,655,660 A * 10/1953 Racz ..... 2/83
2,677,130 A * 5/1954 O'Hayer ..... 2/75
2,775,771 A * 1/1957 Heilbronner ..... 2/270
2,905,944 A 9/1959 Stuart et al.
3,111,676 A * 11/1963 Artzt et al. ..... 2/80
3,214,771 A * 11/1965 Treiber ..... 2/270
3,329,972 A 7/1967 Schwab et al.
3,381,311 A * 5/1968 Wormser ..... 2/270
3,416,518 A * 12/1968 Samuels et al. ..... 602/3
4,015,448 A * 4/1977 Knohl ..... 66/185
4,021,860 A * 5/1977 Swallow et al. ..... 2/239
4,054,129 A * 10/1977 Byars et al. ..... 601/152
4,069,515 A * 1/1978 Swallow et al. ..... 2/239
4,149,274 A * 4/1979 Garrou et al. ..... 2/239
4,180,065 A * 12/1979 Bowen ..... 602/63
4,181,982 A * 1/1980 Segovia ..... 2/239
4,341,096 A * 7/1982 Safrit et al. ..... 66/185
4,475,253 A * 10/1984 Laveckis ..... 2/269
4,559,647 A * 12/1985 Smith et al. ..... 2/158
4,669,126 A * 6/1987 Jones ..... 2/22
4,773,100 A * 9/1988 Kuo ..... 2/46
4,944,041 A * 7/1990 Buenos et al. ..... 2/84
5,067,179 A 11/1991 Wormser
5,125,117 A 6/1992 Buenos et al.
5,230,333 A * 7/1993 Yates et al. ..... 607/111
5,308,275 A * 5/1994 Kornbleuth ..... 446/28

(Continued)

*Primary Examiner*—Alissa L Hoey
(74) *Attorney, Agent, or Firm*—Whyte Hirschboeck Dudek SC

(57) ABSTRACT

A stocking to be worn on a foot of a person, includes a flattenable hollow tube of stretch material having a first portion with a first open end, a second portion extending from the first portion and having a second open end, and a folded portion folded backward from the second open end of the second portion to surround the second portion and having a circumferentially extending connecting part secured to the second portion along a circumferentially extending securing line, and a circumferentially extending open part movable between a folded position, where the circumferentially extending open part of the folded portion is folded back to surround a corresponding area of the second portion, and an unfolded position, where the circumferentially extending open part of the folded portion is extended forward from the second open end of the second portion away from the second portion.

2 Claims, 9 Drawing Sheets

U.S. PATENT DOCUMENTS

| | | | | | |
|---|---|---|---|---|---|
| 5,473,781 | A | * | 12/1995 | Greenberg | 2/239 |
| 5,509,143 | A | * | 4/1996 | Yates et al. | 2/160 |
| 5,533,209 | A | | 7/1996 | Davis | |
| 5,617,583 | A | * | 4/1997 | Yates et al. | 2/160 |
| 5,815,837 | A | * | 10/1998 | Christman et al. | 2/158 |
| 5,867,825 | A | * | 2/1999 | Scheerer | 2/69 |
| 6,076,189 | A | * | 6/2000 | Christman et al. | 2/158 |
| 6,253,381 | B1 | * | 7/2001 | Kelley | 2/125 |
| 6,338,163 | B1 | * | 1/2002 | Markson | 2/163 |
| 6,415,448 | B1 | * | 7/2002 | Glogover | 2/239 |
| 6,839,911 | B1 | * | 1/2005 | Mathews | 2/93 |
| 6,996,847 | B2 | * | 2/2006 | Anderson et al. | 2/16 |
| 7,290,291 | B2 | * | 11/2007 | Anderson et al. | 2/159 |
| 2002/0108166 | A1 | * | 8/2002 | Abboud | 2/239 |
| 2008/0034477 | A1 | * | 2/2008 | Symonds-Powell | 2/239 |

* cited by examiner

STOCKING

BACKGROUND OF THE INVENTION

1. Field of the Invention

This invention relates to a stocking to be worn on a foot of a person, more particularly to a stocking having a folded portion with an open part which can be folded to expose toes or foot and which can be pulled to cover the toes or foot.

2. Description of the Related Art

In general, a dancer wears stockings with an opening so as to meet the dancer's requirements, for example, to expose toes for covering them with taps through the opening when performing ballet or to expose dancer's feet by folding a part of the stocking to an upper position of a leg of the dancer from the opening when performing modern dance or modern ballet (a stronger friction force is required) In addition, such stocking can be used for a common user who is likely to expose the toes or feet, e.g., to have a pedicure without taking off the stocking.

For this purpose, as shown in FIGS. 1 to 3, U.S. Pat. No. 6,415,488 discloses a conventional stocking 200 including a single continuous tube 210 which has a main body 211 and an end portion 212, and a securing arrangement 220. Each of the main body 211 and the end portion 212 has opposite first and second side edges 211*a*, 211*b*, 212*a*, 212*b* when they are flattened. The securing arrangement 220 connects the first side edge 211*a* of the main body 211 with the first side edge 212*a* of the end portion 212, and connects the second side edge 211*b* of the main body 211 with the second side edge 212*b* of the end portion 212 such that the entire end portion 212 is selectively foldable back on an upper portion of the main body 211 so as to be positioned to a top of a foot of a person, or a lower portion of the main body 211 so as to be positioned to a bottom of the foot of the person. However, the stocking 200 has disadvantages in that, when moving between the top and bottom of the foot, since the first side edges 211*a*, 212*a* and the second side edges 211*b*, 212*b* are connected with each other, respectively, pulling operation of a layer 280 (see FIGS. 2 and 3) forwardly toward toes becomes difficult, and the securing arrangement 220 (such as stitching) is likely to be damaged due to repeated pulling of the layer 280.

Therefore, there is a need in the art to provide a stocking which can be easily moved between a folded position and an unfolded position without damaging the securing arrangement.

SUMMARY OF THE INVENTION

Therefore, the object of the present invention is to provide a stocking that can overcome the aforesaid drawbacks of the prior art.

According to this invention, a stocking to be worn on a foot of a person, includes a flattenable hollow tube of a stretch material having a first portion with a first open end, a second portion extending from the first portion and having a second open end, and a folded portion folded backward from the second open end of the second portion to surround the second portion and having a circumferentially extending connecting part secured to the second portion along a circumferentially extending securing line, and a circumferentially extending open part movable between a folded position, where the circumferentially extending open part of the folded portion is folded back to surround a corresponding area of the second portion, and an unfolded position, where the circumferentially extending open part of the folded portion is extended forward from the second open end of the second portion away from the second portion.

BRIEF DESCRIPTION OF THE DRAWINGS

Other features and advantages of the present invention will become apparent in the following detailed description of the preferred embodiment of this invention, with reference to the accompanying drawings, in which.

DETAILED DESCRIPTION OF THE PREFERRED EMBODIMENT

Figure 1:
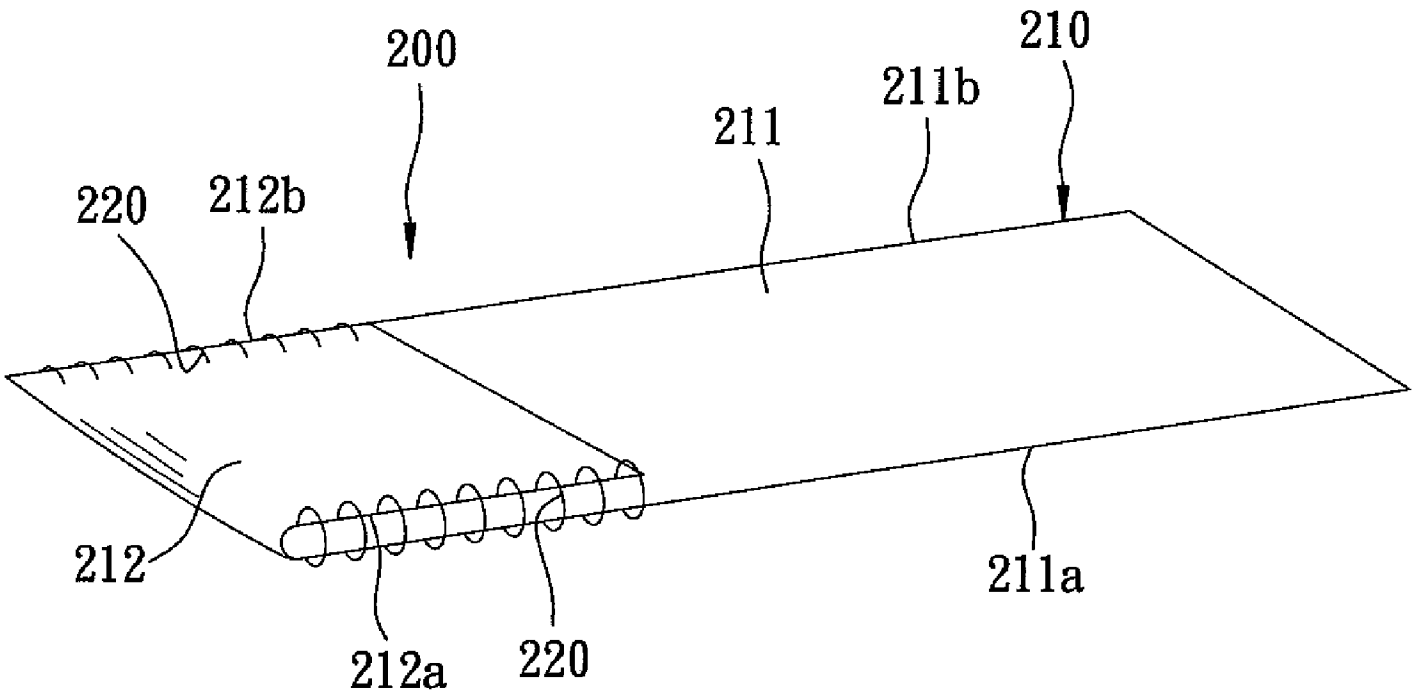
FIG. 1 PRIOR ART
FIG. 1 is a perspective view of a conventional flattened stocking.
Figure 2:
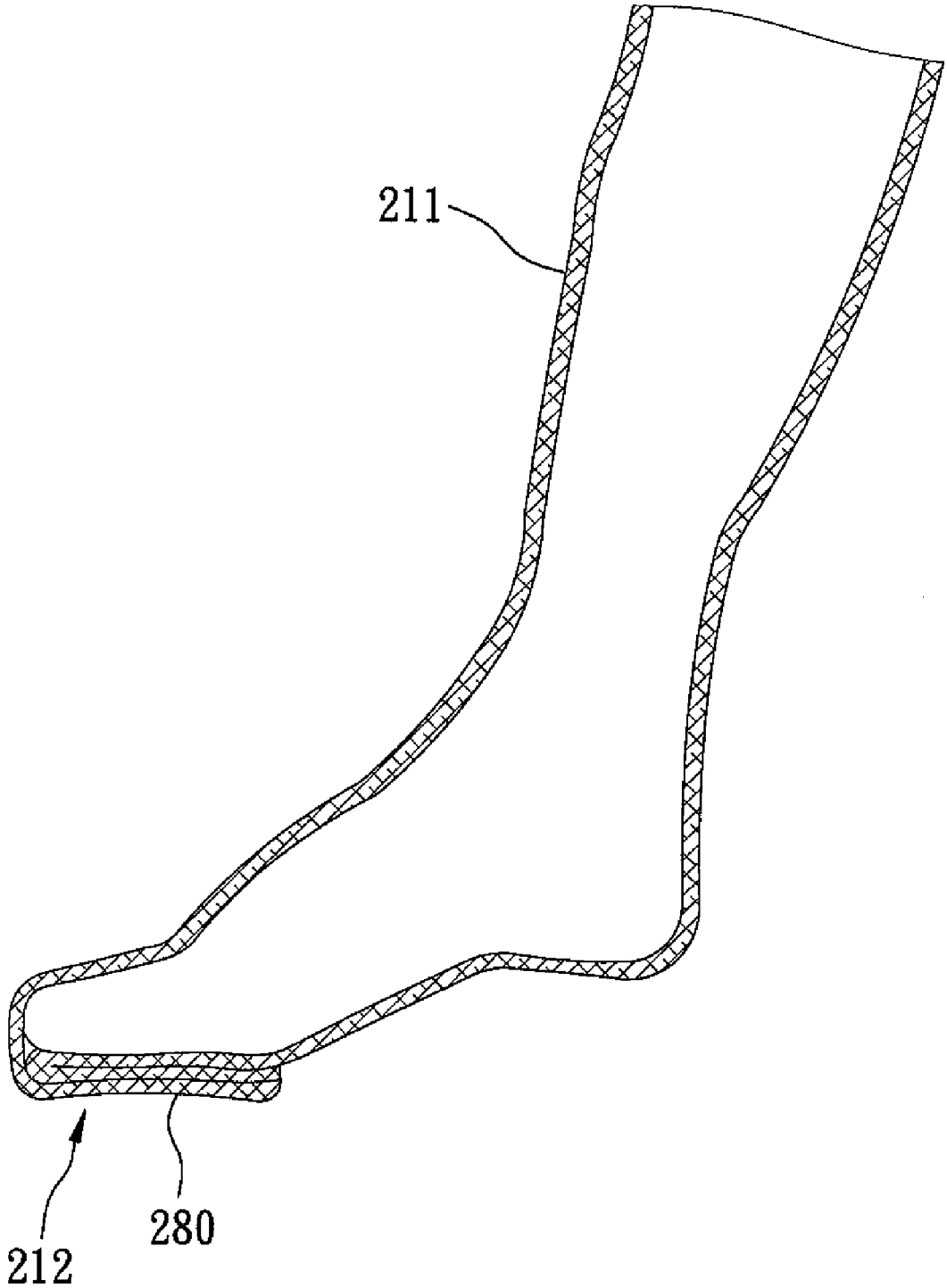
FIG. 2 PRIOR ART
FIG. 2 is a cross-sectional view showing the conventional stocking of FIG. 1 worn on a foot and in a state where an end portion is foldable back on a lower portion of a main body so as to be positioned to a bottom of the foot of the person.
Figure 3:
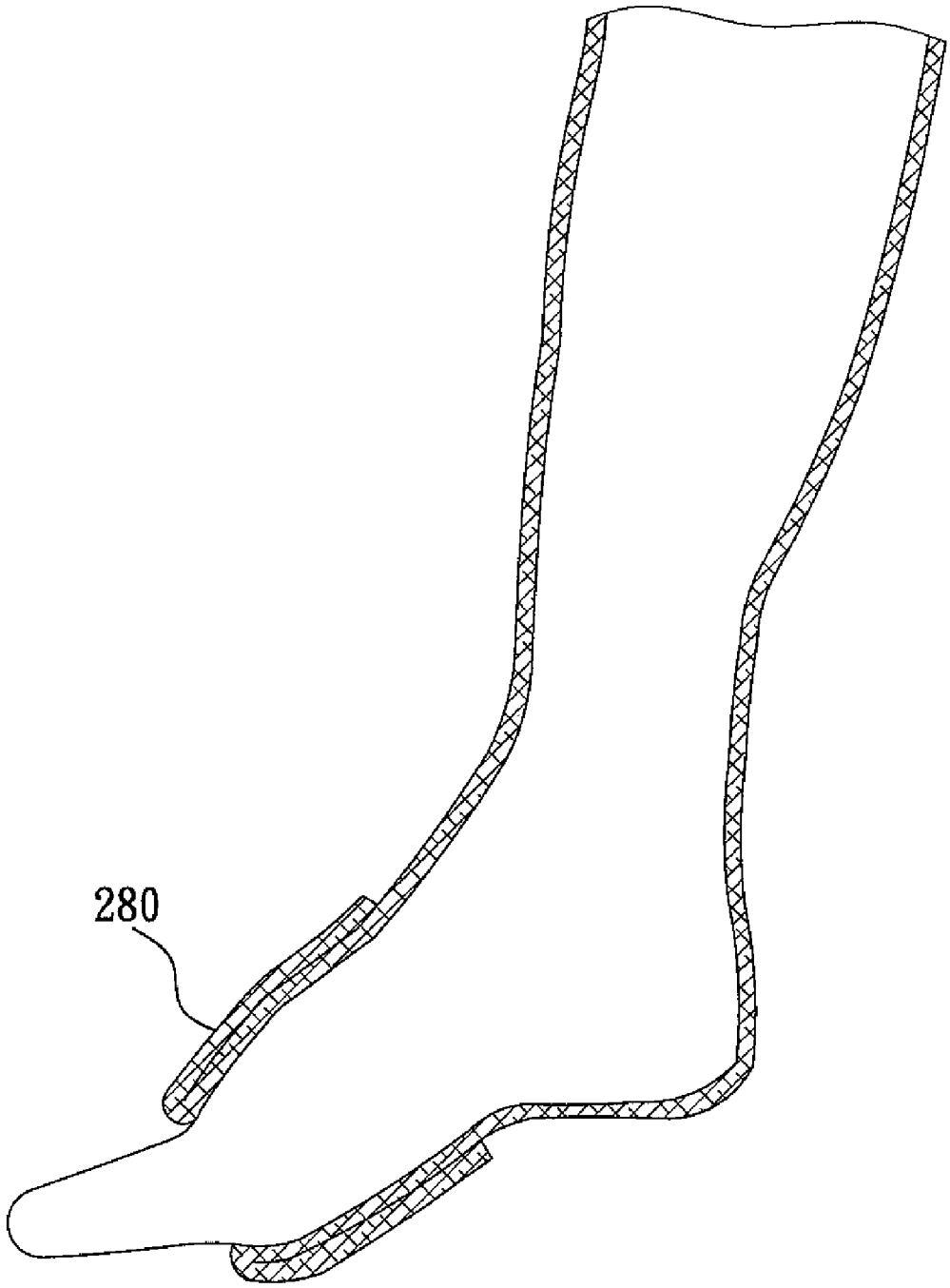
FIG. 3 PRIOR ART
FIG. 3 is a cross-sectional view showing the conventional stocking of FIG. 1 worn on a foot and in another state where the end portion is foldable back on an upper portion of the main body so as to be positioned to a top of the foot.
Figure 4:
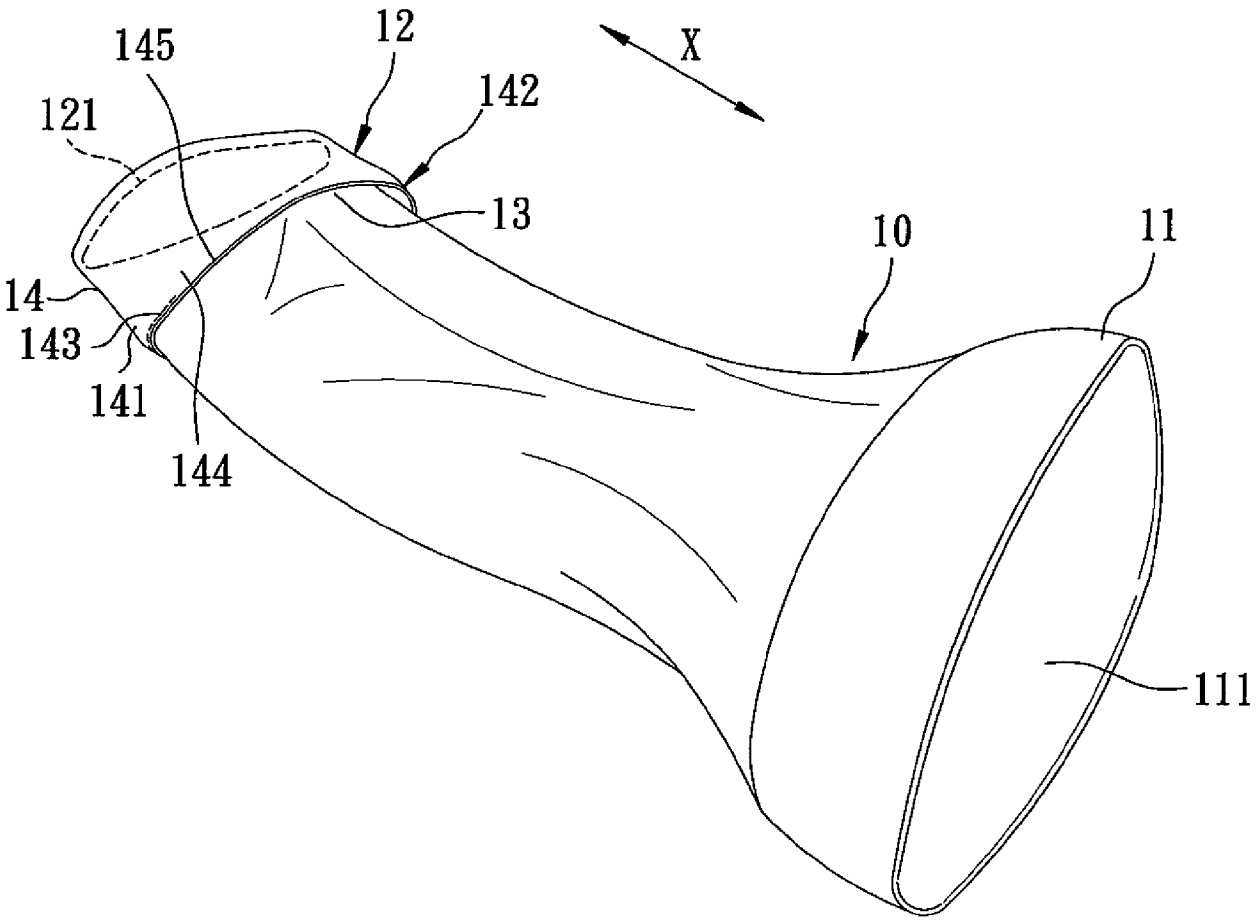
FIG. 4 is a perspective view of the preferred embodiment of a stocking according to this invention.
Figure 5:
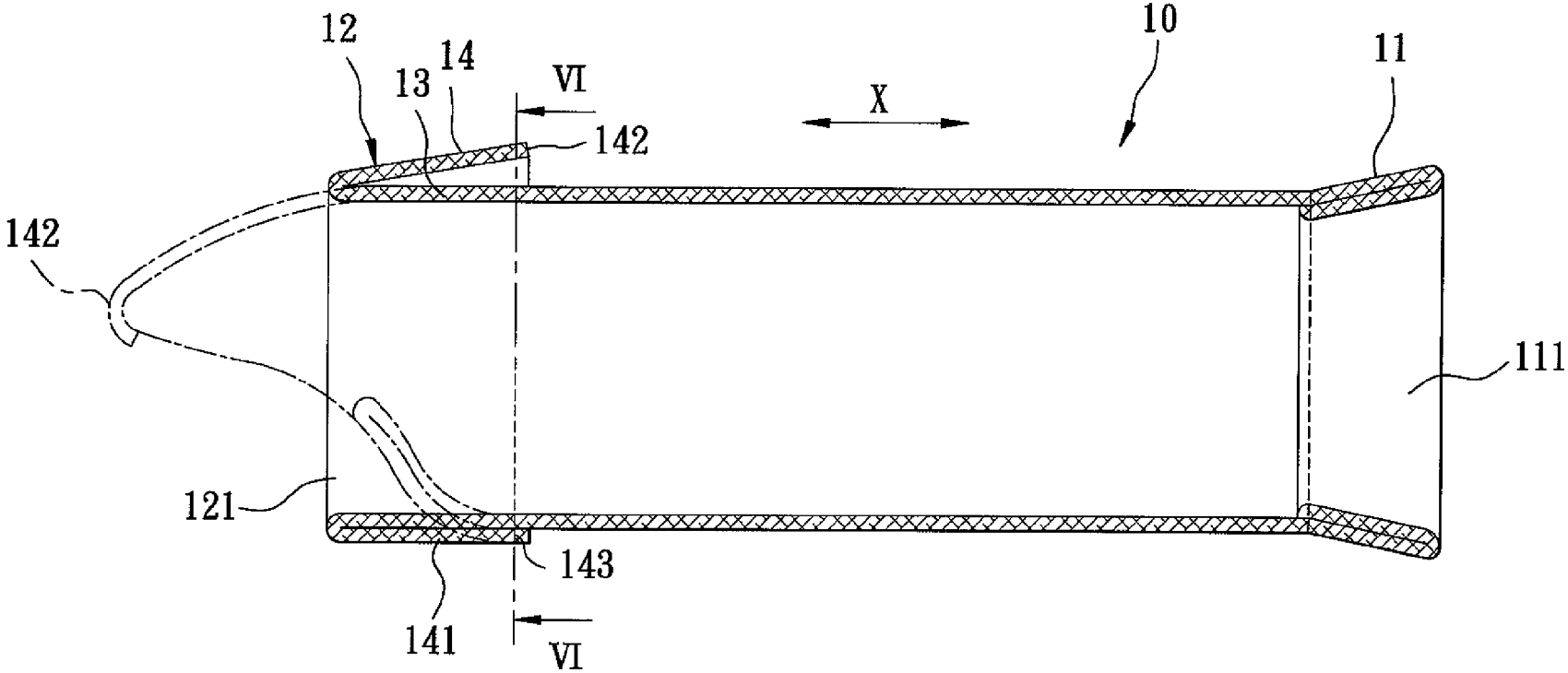
FIG. 5 is a schematic sectional view of the preferred embodiment shown in FIG. 4.
Figure 6:
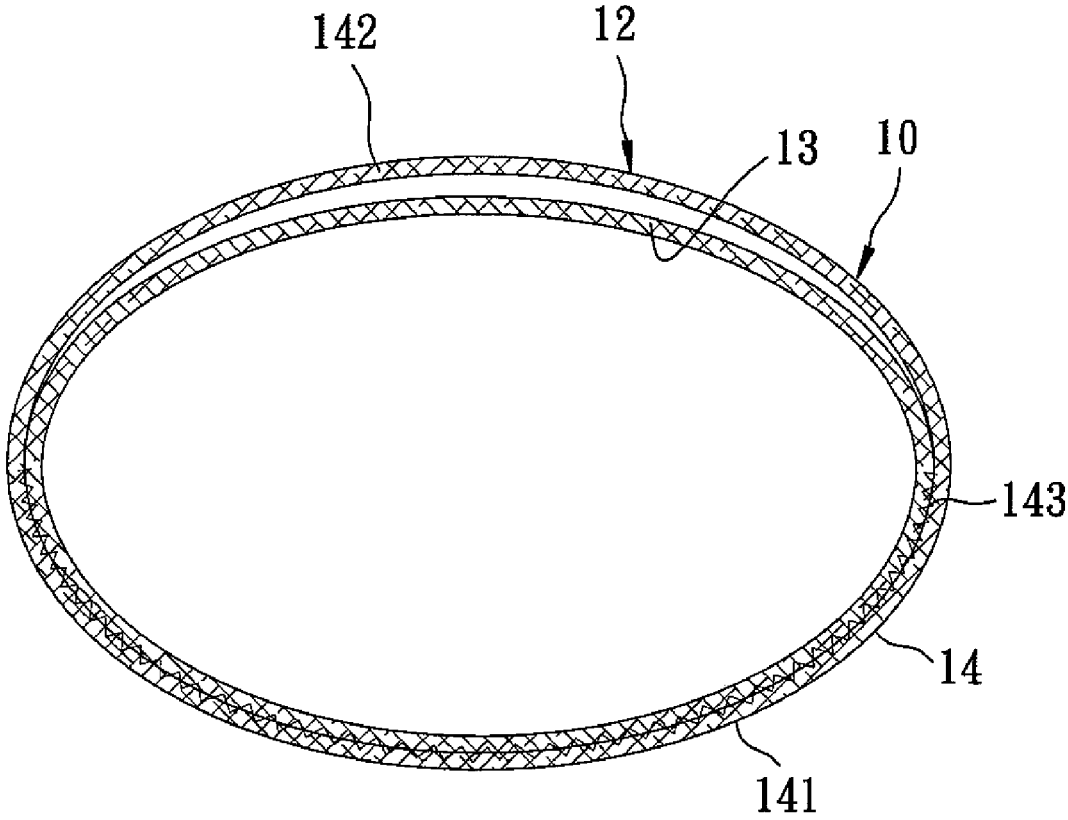
FIG. 6 is a schematic cross-sectional view of the preferred embodiment taken along line VI-VI of FIG. 5.

Referring to FIGS. 4 to 6, the preferred embodiment of a stocking 10 according to the present invention is shown to include a flattenable hollow tube of a stretch material having a first portion 11 with a first open end 111, a second portion 12 extending from the first portion 11 and having a second open end 121, and a folded portion 14 folded backward from the second open end 121 of the second portion 12 to surround the second portion 12 and having a circumferentially extending connecting part 141 secured to the second portion 12 along a circumferentially extending securing line 143, and a circumferentially extending open part 142 movable between a folded position, where the circumferentially extending open part 142 of the folded portion 14 is folded back to surround a corresponding area 13 of the second portion 12, and an unfolded position, where the circumferentially extending open part 142 of the folded portion 14 is extended forward from the second open end 121 of the second portion 12 away from the second portion 12.

Preferably, as shown in FIG. 4, the folded portion 14 has a third open end 144 opposite to the second open end 121 of the second portion 12 in a longitudinal direction (X) and having a peripheral edge 145. The circumferentially extending securing line 143 is along the peripheral edge 145 of the third open end 144.

Preferably, the second open end 121 has a radius and a perimeter. The circumferentially extending securing line 143 has a length in the longitudinal direction (x), which is at least half of the perimeter of the second open end 121. Moreover, the folded portion 14 has a length along the longitudinal direction (X) greater than the radius of the second open end 121.

Figure 7:
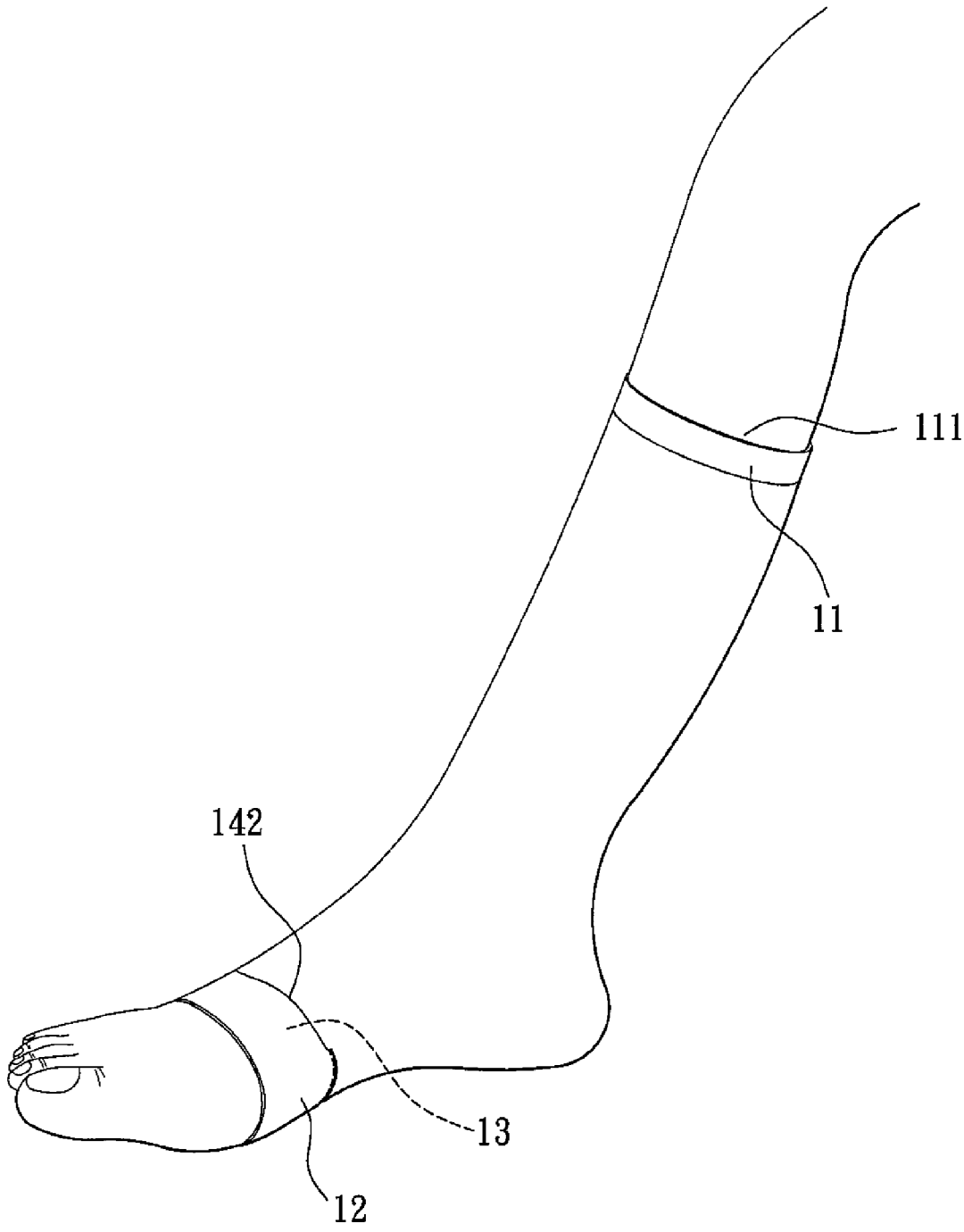
FIG. 7 illustrates the stocking of FIG. 1 worn on a foot of a person and disposed at a folded position.
Figure 8:
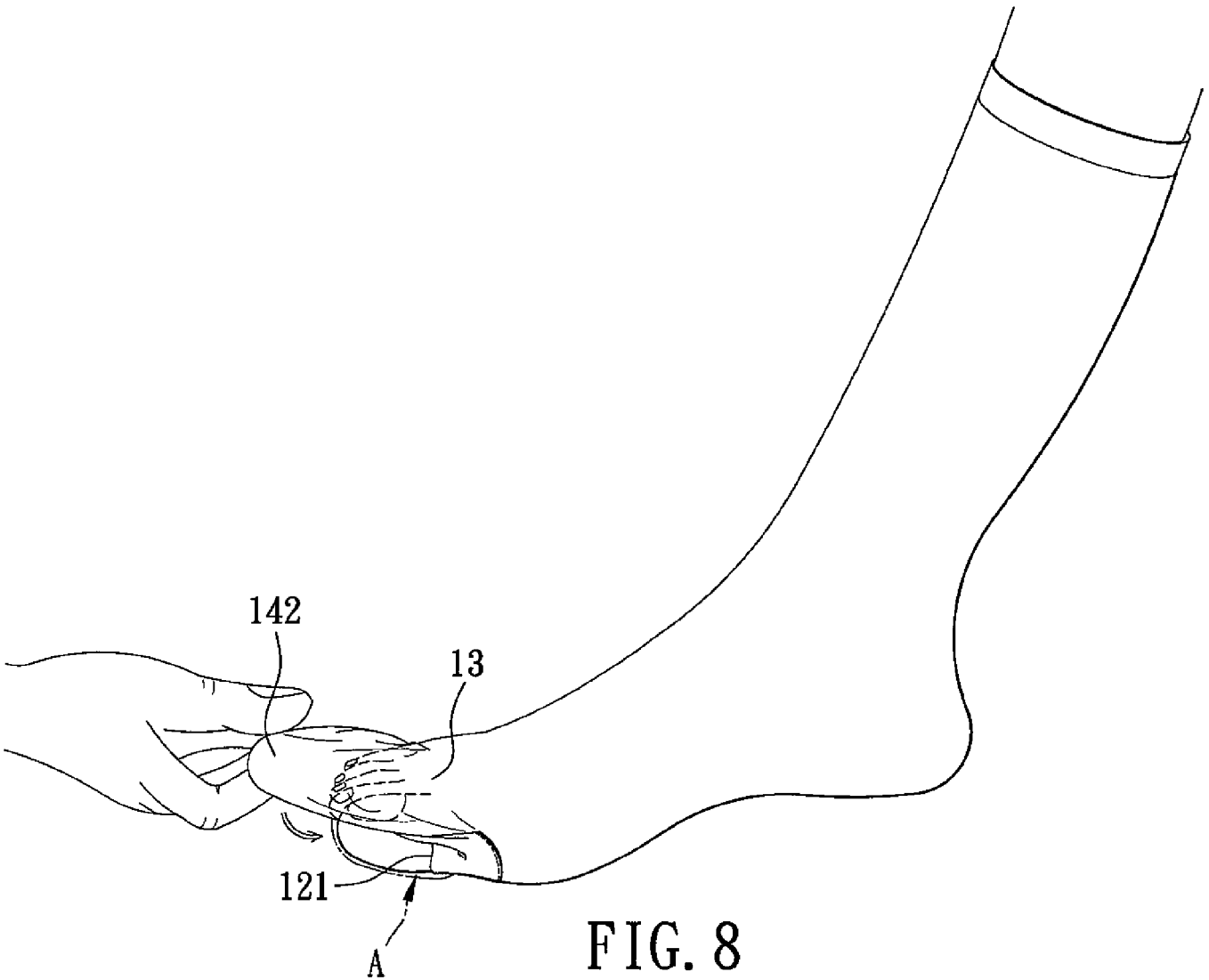
FIG. 8 illustrates the situation where a folded portion of the stocking of FIG. 4 is changed from the folded position to an unfolded position.

FIG. 7 shows the stocking 10 of this invention worn on a foot of a person and disposed at a folded position. At the folded position, the circumferentially extending open part 142 of the folded portion 14 is folded back to surround a corresponding area 13 of the second portion 12 so that toes are revealed. When the toes are likely to be covered, as shown in FIG. 8, the folded portion 14 of the stocking 10 is pulled forward toward the toes to cover the same (i.e., at the unfolded position), preferably, to cover the second open end 121 of the second portion 12 (see the position indicated by arrow A) as well.

Furthermore, the stocking 10 can be restored to the folded position by folding the folded portion 14 back onto the corresponding area 13 of the second portion 12.

Figure 9:
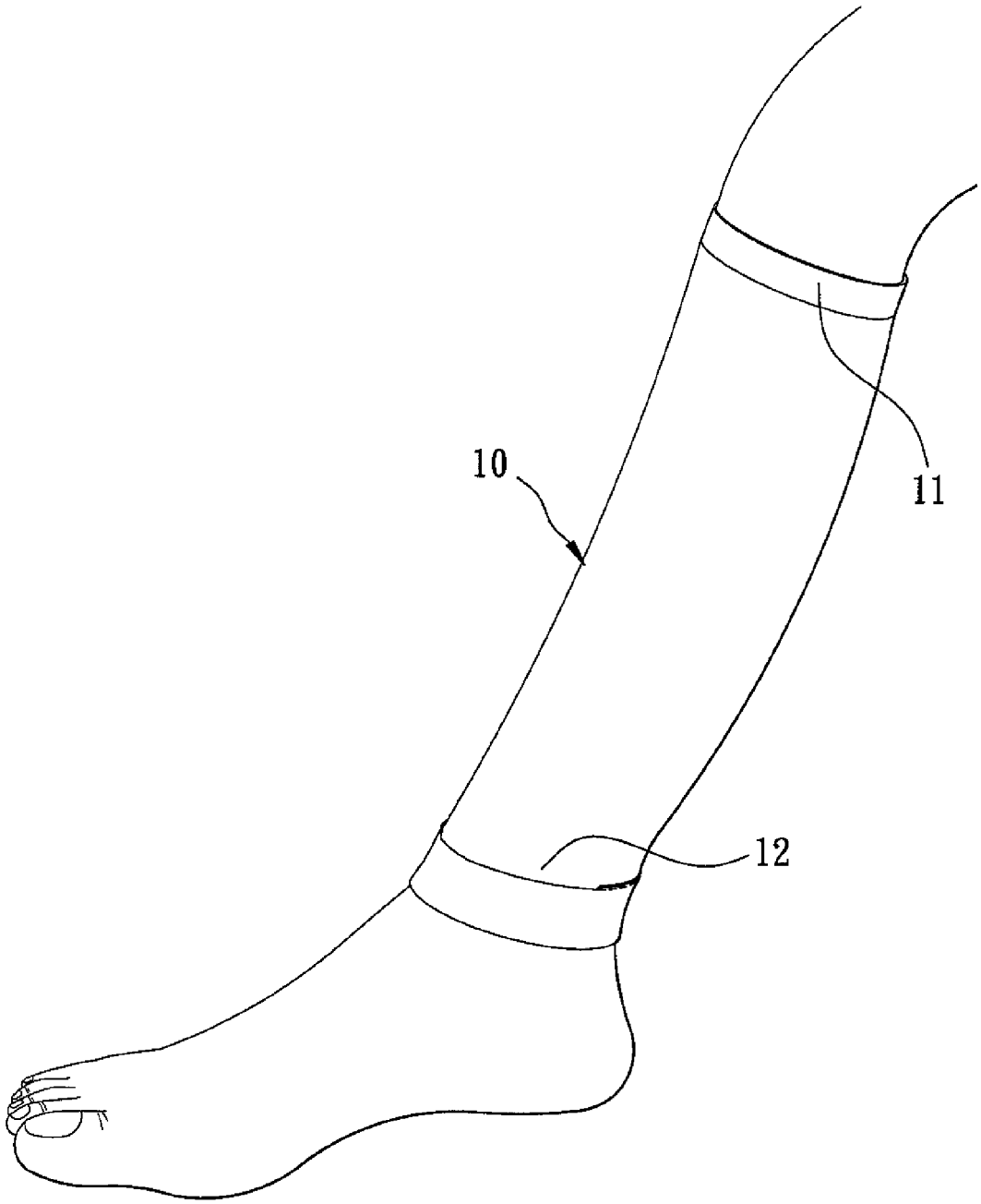
FIG. 9 illustrates the stocking of FIG. 4 worn on a foot of a person and disposed at another folded position.

In addition, if the foot is to be totally exposed, the stocking 10 can be pulled upwardly such that the second open end 121 of the second portion 12 of the stocking 10 (which is at the folded position) is located at the user's ankle (see FIG. 9).

It should be noted that the stocking 10 of this invention refers to a stocking which is intended to cover the foot and at least a portion of the leg of the person. In addition, the circumferentially extending securing line 143 can be continuous or discontinuous.

According to the present invention, with the simple construction of the stocking 10 according to this invention, the user can easily change the wearing type by moving the folded portion 14 between the folded position and the unfolded position without damaging the circumferentially extending securing line 143 as encountered in the aforesaid conventional stocking 200.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A stocking to be worn on a foot of a person, comprising a flattenable hollow tube of a stretch material having a first portion with a first open end, a second portion extending from said first portion and having a second open end that has a perimeter and is opposite to said first open end, and a folded portion connected to and foldable backward from said second open end of said second portion, said folded portion having a third open end with a peripheral edge that extends loopedly between said first and second open ends and around said second portion when said folded portion is folded, said folded portion further having a circumferentially extending connecting part secured to said second portion along a circumferentially extending securing line having a length which is at least half of the perimeter of said second open end and disposed circumferentially on a portion of said peripheral edge, and a circumferentially extending open part extending along a remaining portion of said peripheral edge, said circumferentially extending open part being movable between a folded position, where said circumferentially extending open part of said folded portion is folded back to surround a corresponding area of said second portion, and an unfolded position, where said circumferentially extending open part of said folded portion is extended forward from said second open end of said second portion and away from said corresponding area of said second portion.

2. The stocking of claim 1 wherein said second open end has a radius, said folded portion having a length along the longitudinal direction which is greater than the radius of said second open end.

* * * * *